US008075075B2

(12) United States Patent
Haller et al.

(10) Patent No.: US 8,075,075 B2
(45) Date of Patent: Dec. 13, 2011

(54) COOLING APPLIANCE

(75) Inventors: Erna Haller, Edelbeuren (DE); Rudolf Gottschling, Bad Wurzach (DE)

(73) Assignee: Liebherr-Hausgerate Ochsenhausen GmbH, Ochsenhausen (DE)

( * ) Notice: Subject to any disclaimer, the term of this patent is extended or adjusted under 35 U.S.C. 154(b) by 869 days.

(21) Appl. No.: 11/794,381

(22) PCT Filed: Dec. 28, 2005

(86) PCT No.: PCT/EP2005/014095

§ 371 (c)(1),
(2), (4) Date: Mar. 21, 2008

(87) PCT Pub. No.: WO2006/072439

PCT Pub. Date: Jul. 13, 2006

(65) Prior Publication Data

US 2009/0019883 A1 Jan. 22, 2009

(30) Foreign Application Priority Data

Dec. 29, 2004 (DE) ..... 20 2004 020 115 U

(51) Int. Cl.
*F25D 25/00* (2006.01)

(52) U.S. Cl. ..... 312/408

(58) Field of Classification Search ..... 312/404, 312/408, 351, 330.1; 108/13, 26; 220/507, 220/23.83, 23.86, 23.87; 206/804, 815, 564; 62/465

See application file for complete search history.

(56) References Cited

U.S. PATENT DOCUMENTS

| | | | | | |
|---|---|---|---|---|---|
| 1,180,750 | A | * | 4/1916 | Wolf | 312/231 |
| 1,379,134 | A | * | 5/1921 | Steddom | 312/231 |
| 2,297,859 | A | * | 10/1942 | Anderson | 62/286 |
| D160,314 | S | * | 10/1950 | Fuller | D7/637 |
| 2,638,040 | A | * | 5/1953 | Murphy | 355/113 |
| 2,830,709 | A | * | 4/1958 | Hall | 211/153 |
| 2,979,223 | A | * | 4/1961 | Rideout | 220/812 |
| 3,532,247 | A | * | 10/1970 | Bridges | 220/23.6 |
| 4,235,282 | A | * | 11/1980 | de Filippis et al. | 165/61 |
| 5,040,678 | A | * | 8/1991 | Lenmark et al. | 206/443 |
| 5,234,108 | A | * | 8/1993 | Jorgensen | 206/575 |
| 5,479,866 | A | * | 1/1996 | Rae | 108/44 |
| 5,984,347 | A | * | 11/1999 | Blanc-Rosset | 280/727 |
| 5,988,779 | A | * | 11/1999 | Tu et al. | 312/291 |
| 6,047,701 | A | * | 4/2000 | Feldman | 131/303 |
| 2004/0074399 | A1 | * | 4/2004 | Zhou et al. | 99/448 |
| 2004/0135481 | A1 | * | 7/2004 | Diebold et al. | 312/408 |
| 2005/0017617 | A1 | * | 1/2005 | Becke | 312/404 |
| 2007/0176469 | A1 | * | 8/2007 | Day | 297/153 |
| 2007/0228909 | A1 | * | 10/2007 | Hwang et al. | 312/408 |
| 2009/0100591 | A1 | * | 4/2009 | Lee et al. | 4/548 |

FOREIGN PATENT DOCUMENTS

| | | | |
|---|---|---|---|
| DE | 4128504 | | 3/1993 |
| DE | 19751308 | | 5/1999 |
| EP | 0325217 | | 7/1989 |
| EP | 0832596 | * | 1/1998 |

(Continued)

*Primary Examiner* — Janet M Wilkens
(74) *Attorney, Agent, or Firm* — Dilworth & Barrese, LLP

(57) ABSTRACT

A cooling appliance, in particular to a refrigerator or to a freezer, has at least one tray located in the cooling space of the cooling appliance, with an insert provided which is movable with respect to the tray and which forms the surface of the unit having the tray and the insert, at least regionally in at least one position.

16 Claims, 4 Drawing Sheets

FOREIGN PATENT DOCUMENTS

| | | | |
|---|---|---|---|
| JP | 7-019722 | 1/1995 | |
| JP | 8-145555 | 6/1996 | |
| JP | 2002-228352 | 8/2002 | |
| WO | 2009/127576 | * | 10/2009 |

* cited by examiner

COOLING APPLIANCE

The invention relates to a cooling appliance, in particular to a refrigerator or freezer having at least one tray located in the cooling space of the cooling appliance.

BACKGROUND OF THE INVENTION

The design and the arrangement of such trays in the cooling spaces of cooling appliances are known in a number of different variants. The trays serve, independently of their specific configuration, for the receiving of the product to be cooled or to be frozen, with the latter naturally being able to be goods of the most varied shapes and sizes. Previously known trays frequently have a non-variable, largely smooth surface which serves as a support for all of the goods placed in independently of the shape and size of the product to be cooled or to be frozen.

SUMMARY OF THE INVENTION

It is the underlying object of the present invention to further develop a cooling appliance of the initially named kind such that the trays can be adapted to different demands.

This object is solved by a cooling appliance having the features described herein. According to this, an insert is provided which is movable relative to the tray and which forms the surface of the unit comprising the tray and the insert at least regionally in at least one position. The insert can be configured in the shape of a plate. In a preferred aspect of the invention, the insert is arranged such that it can be turned over as required so that the upwardly disposed side of the insert can be adapted to the given demands. The term "movable" includes e.g. the case that the insert can be removed from the tray or e.g. also the case that the insert can admittedly not be removed, but is variable in its position relative to the tray.

In a further aspect of the invention, a recess is arranged on the upper side of the tray. The insert or the recess is dimensioned such that the insert can be placed into the recess and is thereby fixed in its position.

The insert can have an upper side and a lower side which have structured surfaces which differ from one another. It is, for example, conceivable that the insert has a surface comprising at least one recess on one side. Provision can further be made for the insert to be made smooth on one side and for it thus to be able to serve as a usual planar storage surface. With an upper side and a lower side of the insert which are made differently, different surface structures can be realized so that a corresponding variability and adaptation to different demands is possible.

In a further aspect of the invention, the recess for the receiving of the insert has a closed peripheral rim. Provision can be made alternatively to this for the recess to be configured open toward one or more sides of the tray.

The insert can be removed from the tray, i.e. it can be completely taken off the tray. It is generally furthermore possible for the insert not to be completely removable from the tray, but for it only to be displaceable or pivotable relative to the tray or to a recess provided therein. It is also conceivable for the insert to be arranged pivotably relative to the tray via a suitable pivot device such that it can be turned over.

The shape of the recess can largely be any desired. It is possible that the recess is angular, for example rectangular or square or has roundings, i.e. is circular or oval, for example.

Provision is made in a further aspect of the invention for the depth of the recess to correspond approximately to the height of the insert or to exceed it. If the depth of the recess corresponds to the height of the insert, a flush surface results between the insert and the surface of the tray surrounding the recess. If the depth of the recess exceeds the height of the insert, a stepped embodiment accordingly results.

In a particularly preferred aspect of the invention, a plate is provided which is dimensioned such that it can be received in the recess. The plate can, for example, be a glass plate. However, any embodiments deviating therefrom are also conceivable. Due to the said dimensioning of the glass plate, it is possible to arrange said plate beneath the said insert if it is not required as a storage surface. The particular advantage results from this that a separate stowage space outside the tray or the cooling appliance is not required for the reception of the plate. If the plate is not needed as a storage surface, it can be positioned beneath the insert in the recess of the tray. If it is needed, it can be removed from there and placed on top of the insert and can form a part of the storage surface in this manner.

It is particularly advantageous for the depth of the recess of the tray to correspond to the sum of the thickness of the plate and the height of the insert. For this case, a flush arrangement results between the plate and/or the insert and the regions of the tray surrounding the recess independently of whether the plate lies above or below the insert.

Provision is made in a further aspect of the invention for one or more cut-outs to be provided in the marginal region of the recess of the tray for the removal of the insert and/or of the plate. It is possible in this manner to remove the insert and/or the plate without problem. Cut-outs can additionally or alternatively be arranged in the insert and/or in the plate, for example in their marginal regions.

It is particularly preferred for the tray to have heat-insulating properties and to separate two compartments of the cooling appliance operated at different temperatures. If the tray is configured for removal from the cooling appliance, a particularly flexible configuration of the cooling appliance results with a correspondingly high variability. The tray can have an intermediate space 12 as shown in FIG. 3, which is arranged between its upper side and its lower side and in which an insulation medium is arranged. The intermediate space 12 can be air-filled or filled with a foam 13.

BRIEF DESCRIPTION OF THE DRAWINGS

In a preferred aspect of the invention, the tray comprises a tub-shaped substructure body onto which a glass plate is placed, with the aforesaid intermediate space being formed between the substructure body and the glass plate bonded thereto.

Further details and advantages of the invention will become apparent with reference to an embodiment shown in the drawing. There are shown:

FIGS. 2*a*-2*d*: different views of a tray with a recess and an insert with a glass plate received therein; wherein FIG. 2*a* is plan view of the tray, FIG. 2*b* is a perspective view, and FIGS. 2*c* and 2*d* are sectional views.

DESCRIPTION OF THE PREFERRED EMBODIMENTS

Figure 1A:
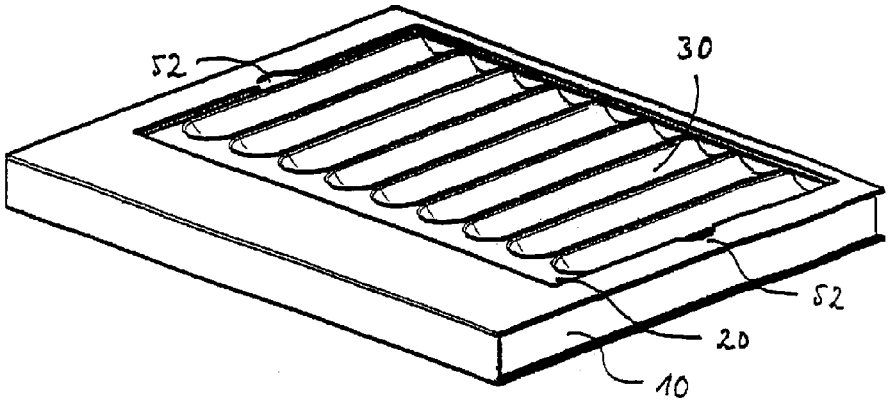
FIGS. 1*a* and 1*b*: perspective illustrations of a tray with a recess with and without an insert located in the recess.

FIG. 1*a* shows a substantially rectangular tray 10 which is received in the inserted state in the cooling space of a cooling appliance, in particular of a refrigerator or of a freezer, by means of suitable holders. On its upper side, the tray 10 has the recess 50 which can be seen from FIG. 1*b* and which is likewise made in rectangular shape. The recess 50 has a base which extends parallel to the tray 10. Furthermore, the recess 50 is bounded by four side walls, that is it is surrounded over the whole periphery by the marginal regions of the tray 10, as can be seen from FIG. 1*b*.

Figure 1B:
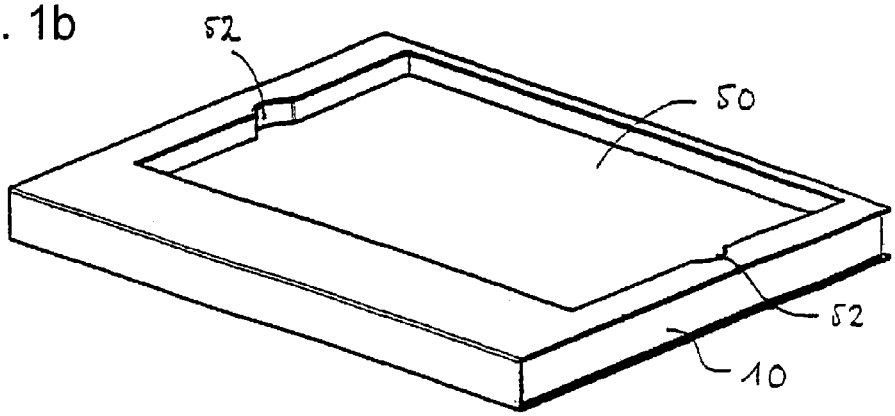

Apart from the embodiments of the tray 10 and of the recess 50 shown in FIG. 1*b*, any desired embodiments and arrangements deviating from them are naturally possible. It is possible, for example, to configure the recess not as rectangular, but as square or rounded, for example circular or oval. The most varied design possibilities also result for the tray 10 itself.

As can be seen from FIG. 1*a*, an insert 20 is provided which is configured such that it can be received in the recess 50. The outer dimensions of the insert 20 correspond to or are slightly below the dimensions of the cut-out 50 so that the insert 20 is received in the recess 50 without any clearance or with only slight clearance.

The insert 20 has at its upper side shown FIG. 1*a* a plurality of elongated recesses 30 which are arranged parallel to one another and which serve for the reception of bottles. As can be seen from FIG. 1*a*, the recesses 30 are configured to be open on one side, that is they form a part of the marginal region of the insert 20. In their end region remote therefrom, the recesses 30 are made rounded and merge into the surface of the insert 20.

As can further be seen from FIGS. 1*a* and 1*b*, two oppositely disposed semi-circular cut-outs 52 are arranged in the marginal region of the recesses 50 and serve for the engagement and for the removal of the insert 20. It is likewise possible to provide only one cut-out or more than two cut-outs. The cut-outs can be semi-circular or can also have a different shape. Alternatively or additionally, provision can be made for the cut-outs to be provided inwardly disposed at the insert and/or at the glass plate.

At its lower side not visible in FIG. 1*a*, the insert 20 in accordance with FIG. 1*a* preferably has a design deviating from the upper side visible from the top of FIG. 1*a*. It is, for example, conceivable for the lower side of the insert 20 to be planar. If the insert 20 is turned over from the orientation shown in FIG. 1*a*, a smooth surface thus results in the region of the recess 50.

As can be seen from FIG. 1*a*, the height of the insert 20 is slightly below the depth of the recess 50 so that a step-shaped portion is formed in the transition region between the insert 20 and the surface of the tray 10.

A further embodiment of the invention can be seen from FIG. 2. FIG. 2*a* shows a plan view of the tray in accordance with the invention with the insert and with the plate 60 disposed thereon; FIG. 2*b* shows a perspective view; FIG. 2*c* shows a sectional view in accordance with line E-E in FIG. 2*a* and FIG. 2*d* shows a sectional view in accordance with the line F-F in FIG. 2*a*.

The FIGS. 2*a* to 2*d* show the tray 10 with the recess 50 in accordance with FIGS. 1*a* and 1*b*. Deviating from FIGS. 1*a* and 1*b*, however, not only the insert 20 visible from the top of FIG. 1*a* is located in the recess 50, but also the plate 60 made as a glass plate. The plate 60 has a thickness which compensates the difference in height between the insert 20 and the depth of the recess 50, i.e. the insert 20 and the plate 60 together have a height which corresponds to the depth of the recess 50. It results from this that the surface of the plate 60 is flush with the region of the tray 10 which surrounds the recess 50.

Figure 2A:
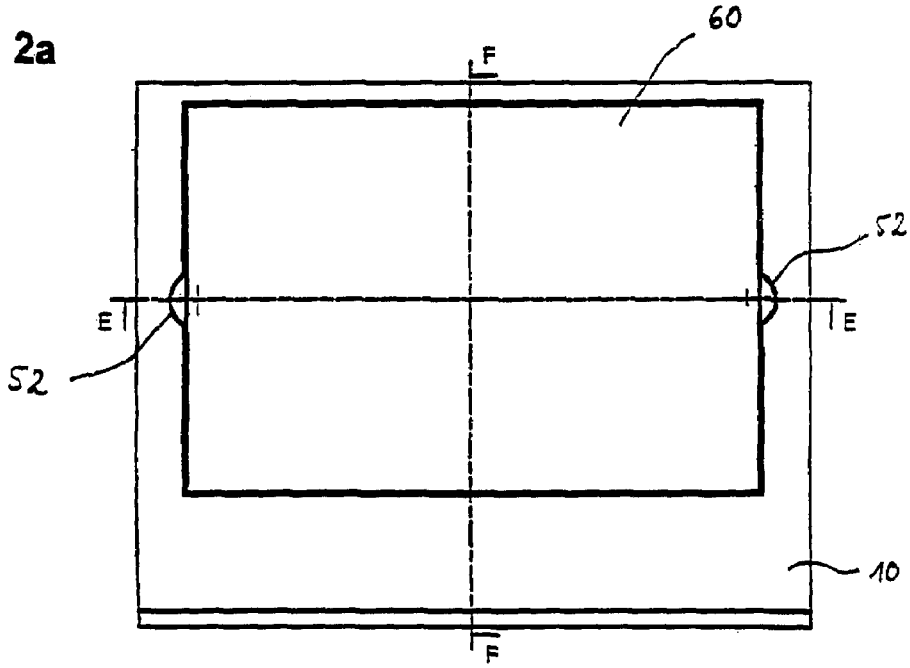
Figure 2B:
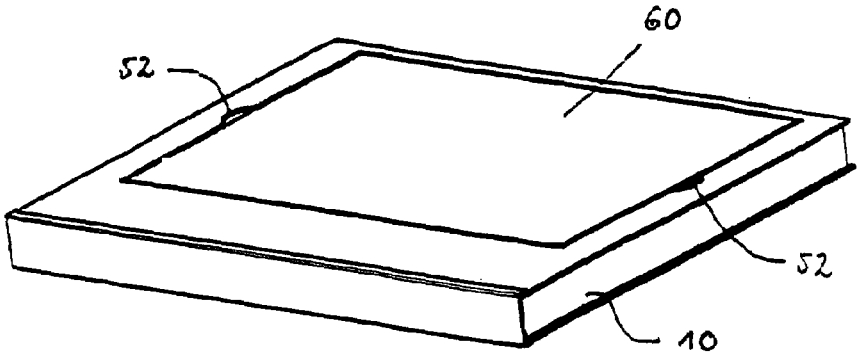
Figure 2D:
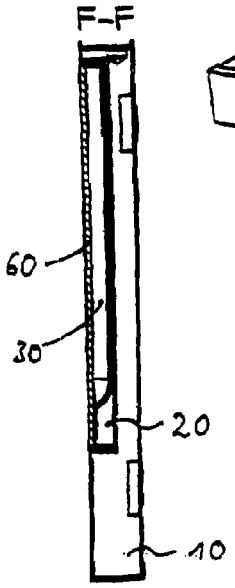
Figure 2C:
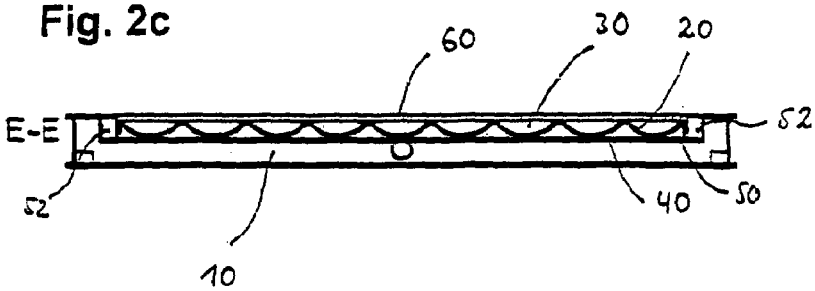
Figure 3:
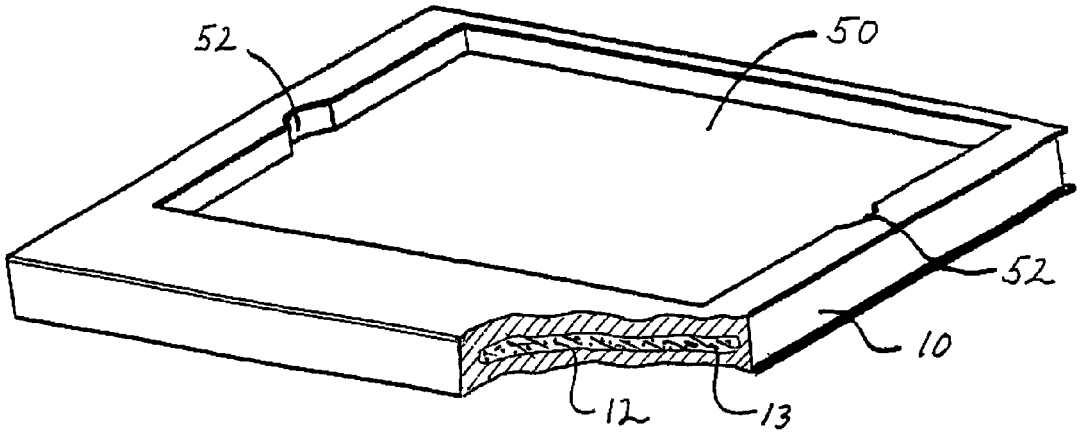
FIG. 3: a partly cut away perspective view of the tray of the invention.

It further results from the sectional views in accordance with FIGS. 2*c* and 2*d* that the plate 60 corresponds with respect to its width and length to that of the insert 20. The width and length of the plate 60 as well as of the insert 20 correspond to the width or length of the recess 50 or are slightly below them.

In the arrangement shown in FIG. 2, the plate 60 is located above the insert 20 and thus forms a part of the storage surface. If it is instead desired that the wavy surface of the insert 20 forms the upper side, the plate 60 and the insert 2*b* can be removed by means of the cut-outs 52 and the plate 60 can be arranged at the bottom and the insert 20 thereabove so that the cut-outs 30 of the insert 20 form the upper side. Independently of the arrangement of the plate 60 and of the insert 20, there is no need for any separate stowage space for either of these parts. As can be seen from FIG. 2, both parts can be accommodated in the recess 50.

The insert 20 shown in FIG. 2 has a smooth surface 40 on its side remote from the side having the recesses 30. If desired, the planar surface 40 can also form the upper side of the arrangement.

Figure 4:
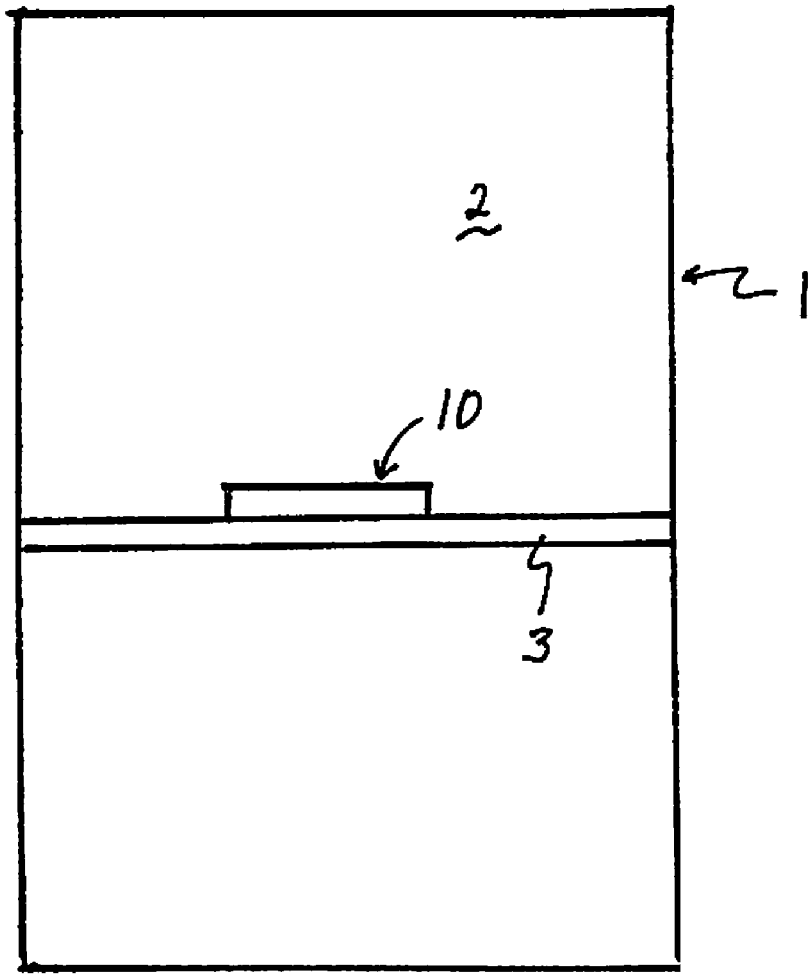
FIG. 4 is a diagrammatic illustration of the tray 10 of the invention in combination with a cooling appliance.

FIG. 4 illustrates the tray 10 of the invention positioned within the cooling space 2 of a cooling appliance 1.

The invention claimed is:

1. A tray assembly in a cooling appliance, which is a refrigerator or a freezer, comprising at least one tray (10) located in the cooling space of the cooling appliance, wherein an insert (20) is provided which is movable with respect to the tray (10) and which forms a surface of a unit comprising the tray (10) and the insert (20) at least regionally in at least one position, wherein the insert (20) includes on at least a first side a plurality of parallel elongated recesses (30) each having a curved bottom surface, each elongated recess (30) having an open end and an opposite rounded end wherein a plate (60) is provided which is dimensioned such that it can be received either beneath or above said insert (20) which is received in a recess (50) in the tray (10).

2. A tray assembly for a cooling appliance in accordance with claim 1, wherein the recess (50) is arranged on an upper side of the tray (10).

3. A tray assembly for a cooling appliance in accordance claim 2, wherein the recess (50) has a closed peripheral rim.

4. A tray assembly for a cooling appliance in accordance with claim 2, wherein the recess (50) is rectangular.

5. A tray assembly for a cooling appliance in accordance with claim 2, wherein the depth of the recess (50) approximately corresponds to the height of the insert (20) or exceeds it.

6. A tray assembly for a cooling appliance in accordance with claim 2, wherein one or more cut-outs (52) are provided in the marginal region of the recess (50) for the removal of the insert (20) and/or of the plate (60).

7. A tray assembly for a cooling appliance in accordance with claim 2, wherein the insert (20) has an upper side and a lower side, which have differently structured surfaces.

8. A tray assembly for a cooling appliance in accordance with claim 1, wherein the insert (20) has an upper side and a lower side, which have differently structured surfaces.

9. A tray assembly for a cooling appliance in accordance with claim 1, wherein the insert (20) has a smooth, planar surface (40) on a second side opposite to the first side.

10. A tray assembly for a cooling appliance in accordance with claim 1, wherein the insert (20) is removable from the tray (10) such that it can be turned over.

11. A tray assembly for a cooling appliance in accordance with claim 1, wherein the plate (60) is a glass plate.

12. A tray assembly for a cooling appliance in accordance with claim 1, wherein the depth of the recess (50) corresponds to the sum of the thickness of the plate (60) and of the height of the insert (20).

13. A tray assembly for a cooling appliance in accordance with claim 1, wherein the tray (10) has heat-insulating properties.

14. A tray assembly for a cooling appliance in accordance with claim 13, wherein the tray (10) has an intermediate space which is arranged between its upper side and its lower side and in which an insulation medium is arranged.

15. A tray assembly for a cooling appliance in accordance with claim 14, wherein the intermediate space is air-filled or filled with a foam (13).

16. A tray assembly for a cooling appliance in accordance with claim 1, wherein the tray (10) is removable from the cooling appliance.

* * * * *